US008364070B2

(12) United States Patent
Watanabe et al.

(10) Patent No.: US 8,364,070 B2
(45) Date of Patent: Jan. 29, 2013

(54) CLEANING DEVICE, AND IMAGE FORMING APPARATUS, PROCESS CARTRIDGE, AND INTERMEDIATE TRANSFER UNIT EACH INCLUDING THE CLEANING DEVICE

(75) Inventors: Kazuhiko Watanabe, Tokyo (JP); Keiji Okamoto, Kanagawa (JP)

(73) Assignee: Ricoh Company, Ltd., Tokyo (JP)

( * ) Notice: Subject to any disclaimer, the term of this patent is extended or adjusted under 35 U.S.C. 154(b) by 123 days.

(21) Appl. No.: 13/064,308

(22) Filed: Mar. 17, 2011

(65) Prior Publication Data

US 2011/0229188 A1 Sep. 22, 2011

(30) Foreign Application Priority Data

Mar. 18, 2010 (JP) ..... 2010-063175

(51) Int. Cl.
*G03G 21/00* (2006.01)

(52) U.S. Cl. ..... 399/350

(58) Field of Classification Search ..... 399/101, 399/111, 350, 351; 430/119.8, 119.82; 15/256.5
See application file for complete search history.

(56) References Cited

U.S. PATENT DOCUMENTS

| | | | | |
|---|---|---|---|---|
| 5,765,088 | A * | 6/1998 | Nakayama et al. | 399/350 |
| 7,369,807 | B2 * | 5/2008 | Naruse et al. | 399/351 |
| 7,383,013 | B2 | 6/2008 | Watanabe et al. | |
| 7,645,849 | B2 * | 1/2010 | Omori et al. | 528/60 |
| 7,711,308 | B2 | 5/2010 | Hozumi et al. | |
| 7,817,956 | B2 * | 10/2010 | Sugimoto | 399/350 |
| 2007/0242992 | A1 | 10/2007 | Watanabe et al. | |
| 2008/0063448 | A1 | 3/2008 | Hozumi et al. | |
| 2008/0286020 | A1 | 11/2008 | Watanabe et al. | |
| 2009/0010692 | A1 | 1/2009 | Hozumi et al. | |
| 2009/0123205 | A1 | 5/2009 | Watanabe et al. | |
| 2010/0061779 | A1 | 3/2010 | Okamoto | |
| 2010/0067945 | A1 | 3/2010 | Hozumi et al. | |
| 2010/0067949 | A1 | 3/2010 | Watanabe et al. | |
| 2010/0247188 | A1 * | 9/2010 | Fukuda et al. | 399/350 |
| 2011/0229186 | A1 * | 9/2011 | Okamoto et al. | 399/101 |
| 2011/0229233 | A1 * | 9/2011 | Watanabe et al. | 399/350 |

FOREIGN PATENT DOCUMENTS

| | | | |
|---|---|---|---|
| JP | 3276462 | B | 2/2002 |
| JP | 2007086202 | A | 4/2007 |
| JP | 2007248737 | A | 9/2007 |

OTHER PUBLICATIONS

Abstract of Japanese Patent Publication No. JP06-208323, published on Jul. 26, 1994.

* cited by examiner

*Primary Examiner* — Robert Beatty
(74) *Attorney, Agent, or Firm* — Harness, Dickey & Pierce, P.L.C.

(57) ABSTRACT

A cleaning device for cleaning a moving surface of a cleaning target includes a laminated blade member including multiple layers including a proximal edge layer, each of the multiple layers made of materials different in permanent set value and a holding member to hold a distal end of the blade member. A proximal edge portion of the blade member at a free, leading end opposite the distal end of the blade member held by the holding member brought into contact with the surface of the cleaning target to clean the surface undergoes a linear pressure reduction rate of approximately 90% or higher.

11 Claims, 6 Drawing Sheets

CLEANING DEVICE, AND IMAGE FORMING APPARATUS, PROCESS CARTRIDGE, AND INTERMEDIATE TRANSFER UNIT EACH INCLUDING THE CLEANING DEVICE

CROSS-REFERENCE TO RELATED APPLICATIONS

The present invention claims priority pursuant to 35 U.S.C. §119 from Japanese Patent Application No. 2010-063175, filed on Mar. 18, 2010 in the Japan Patent Office, which is hereby incorporated by reference herein in its entirety.

BACKGROUND OF THE INVENTION

1. Field of the Invention

The present invention relates to a cleaning device that removes foreign matter adhering to a surface of a surface moving member (i.e., a member having a moving surface). The present invention further relates to an image forming apparatus, such as a copier, a printer, and a facsimile machine, a process cartridge, and an intermediate transfer unit, each of which includes the cleaning device.

2. Description of the Related Art

There is a wide variety of image forming apparatuses, such as electrophotographic image forming apparatuses and inkjet image forming apparatuses, and many of which are provided with surface moving members. For example, some of the electrophotographic image forming apparatuses are provided with surface moving members including a latent image carrying member (i.e., image carrying member), such as a photoconductor drum; an intermediate transfer member (i.e., image carrying member), such as an intermediate transfer belt; and a recording medium conveying member, such as a sheet conveying belt. Further, some inkjet image forming apparatuses are provided with surface moving members including a recording medium conveying member, such as a sheet conveying belt. In general, unnecessary foreign matter adhering to a surface of such a surface moving member causes a variety of problems. Therefore, a cleaning device is used that removes the unnecessary foreign matter from the surface of the surface moving member as a cleaning target.

Related-art cleaning devices that clean a surface of the cleaning target include a cleaning device using a blade member formed by an elastic member made of, for example, urethane rubber molded into a plate shape. In such a cleaning device, the blade member is held by a holding member made of a highly rigid material, such as metal, and fixed to the fixed to the frame of the device, and one end of the blade member is pressed against the surface of the cleaning target to remove the foreign matter adhering to the surface. Such a cleaning device is simple in configuration and low in cost, and exhibits high foreign matter removal performance, and thus is widely used.

In the cleaning device according to the blade cleaning method, it is desired to bring the blade member into contact with the surface of the cleaning target with relatively high contact pressure to obtain high removal performance. It is also desired to maintain the initial contact state of the blade member to obtain stable removal performance over time.

In a single-layer blade member, the entirety of which is made of a uniform elastic material, however, it is difficult to attain both relatively high contact pressure and maintenance of the initial contact state for the following reason.

That is, if a single-layer blade member made of an elastic material of relatively high hardness is used, an edge portion of the blade member in contact with the cleaning target has a relatively small amount of deformation, and an increase in contact area of the blade member in contact with the cleaning target is suppressed. It is therefore possible to set relatively high contact pressure, and to improve the cleaning performance. In general, however, an elastic material of relatively high hardness has a relatively high permanent set value. Since the blade member is in contact with the cleaning target, with one end thereof pressed and flexed against the surface of the cleaning target, if the blade member made of an elastic material having a relatively high permanent set value is kept in continuous contact with the cleaning target for an extended period of time, so-called loss of resilience occurs, i.e., the blade member is substantially permanently deformed in a flexed shape. As a result, the contact state of the blade member over time deviates from the initial contact state, and causes cleaning failure.

By contrast, an elastic material of relatively low hardness generally has a relatively low permanent set value. Therefore, if a single-layer blade member made of an elastic material of relatively low hardness is used, the blade member is relatively resistant to the loss of resilience even if the blade member is kept in continuous contact with the cleaning target for an extended period of time, and the initial contact state can be maintained. However, an edge portion of the blade member in contact with the cleaning target is substantially deformed. Thus, the contact area is increased, and the contact pressure is reduced. As a result, sufficient removal performance is not obtained.

Thus, as described above, in a single-layer blade member, it is difficult to attain both relatively high contact pressure and maintenance of the initial contact state, and to stably obtain high removal performance over time.

Another related-art cleaning device in known, which uses a double-layer laminated blade member made of elastic materials mutually different in hardness. An edge layer of the blade including an edge portion that comes into contact with the cleaning target is made of a material of relatively high hardness, and a backing layer not in contact with the cleaning target is made of a material of relatively low hardness. With the edge layer of relatively high hardness, the edge portion in contact with the cleaning target has a relatively small amount of deformation, and an increase in contact area is suppressed, as in the above-described single-layer blade member made of an elastic material of relatively high hardness. Accordingly, relatively high contact pressure can be set. Further, the backing layer not in contact with the cleaning target has relatively low hardness and a relatively low permanent set value. Accordingly, the blade member is more resistant to the loss of resilience than the single-layer blade member of relatively high hardness, and is capable of maintaining the initial contact state.

FIG. 1 illustrates a schematic view of the blade member provided in the above-described related-art cleaning device. FIG. 1 is a diagram of a double-layer laminated blade member 15 and a blade holder 13 holding the blade member 15. The blade member 15 includes an edge layer 11 made of an elastic material of relatively high hardness and a backing layer 12 made of an elastic material of relatively low hardness.

In the blade member 15 illustrated in FIG. 1, the edge layer 11 having a relatively high permanent set value extends over an entire area from a holding position 15*a* held by the blade holder 13 to the leading end of the blade member 15 on the side of an edge portion 11*e*. Therefore, in a state in which the blade member 15 is pressed and flexed against a cleaning target, not only the backing layer 12, which is relatively resistant to the loss of resilience, but also the edge layer 11, which is relatively susceptible to the loss of resilience, is flexed. If the blade member 15 is kept in continuous contact with the cleaning target for an extended period of time, therefore, a substantial loss of resilience may occur only in the edge layer 11.

If the loss of resilience occurs in the edge layer 11, the edge layer 11 tends to maintain the flexed shape thereof. Thus, the backing layer 12 with little or no loss of resilience receives force acting in the flexing direction. Therefore, the change over time in contact state occurs more easily than in the single-layer blade member made solely of the same material as the material forming the backing layer 12.

Therefore, even if the cleaning device is designed to use the double-layer laminated blade member 15 including the edge layer 11 of relatively high hardness and the backing layer 12 of relatively low hardness, it is difficult in some cases to sufficiently maintain the initial cleaning performance, depending on the combination of the material forming the edge layer 11 and the material forming the backing layer 12.

SUMMARY OF THE INVENTION

The present invention describes a cleaning device. In one example, a cleaning device cleans a moving surface of a cleaning target, and includes a laminated blade member including multiple layers including a proximal edge layer, each of the multiple layers made of materials different in permanent set value and a holding member to hold a distal of the blade member. A proximal edge portion of the edge layer of the blade member at a free, leading end opposite the distal end of the blade member held by the holding member brought into contact with the surface of the cleaning target to clean the surface undergoes a linear pressure reduction rate of approximately 90% or higher.

The edge layer including the proximal edge portion may be made of a material higher in permanent set value than any other one of the materials of the multiple layers.

The edge layer including the proximal edge portion may be made of a material having a 100% modulus value in a range of from approximately 6 MPa to approximately 12 MPa at a temperature of 23 degrees Celsius.

The edge layer including the proximal edge portion may be made of a material in which the difference between the maximum and minimum rebound resilience coefficient values across a temperature change range of from 0 degree Celsius to 50 degree Celsius is approximately 30% or less.

The material forming the edge layer may have a tan δ peak temperature lower than approximately 10 degrees Celsius.

The multiple layers of the blade member may further include a distal backing layer disposed against a distal surface of the edge layer and made of a material in which the difference between the maximum and minimum rebound resilience coefficient values across a temperature change range of from 0 degree Celsius to 50 degrees Celsius is approximately 30% or less.

The multiple layers of the blade member may further include a distal backing layer disposed against a distal surface of the edge layer and made of a material having a tan δ peak temperature lower than approximately 10 degrees Celsius.

The present invention further describes a novel process cartridge. In one example, a novel process cartridge is removably installable in an image forming apparatus that transfers, onto a recording medium, an image formed on a moving surface of a latent image carrying member. The process cartridge may support both the latent image carrying member and the above-described cleaning device as the cleaning target.

The present invention further describes a novel intermediate transfer unit. In one example, a novel intermediate transfer unit may be removably installable in an image forming apparatus that transfers an image formed on a moving surface of an image carrying member onto a moving surface of an intermediate transfer member and then onto a recording medium. The intermediate transfer unit may support both the intermediate transfer member and the above-described cleaning device as a single integrated unit.

The present invention further describes a novel image forming apparatus. In one example, a novel image forming apparatus may include the above-described cleaning device.

Toner particles forming the image may have a shape factor SF1 in a range of from approximately 100 to approximately 150.

BRIEF DESCRIPTION OF THE DRAWINGS

A more complete appreciation of the invention and many of the advantages thereof are obtained as the same becomes better understood by reference to the following detailed description when considered in connection with the accompanying drawings, wherein.

DETAILED DESCRIPTION OF PREFERRED EMBODIMENTS

Figure 1:
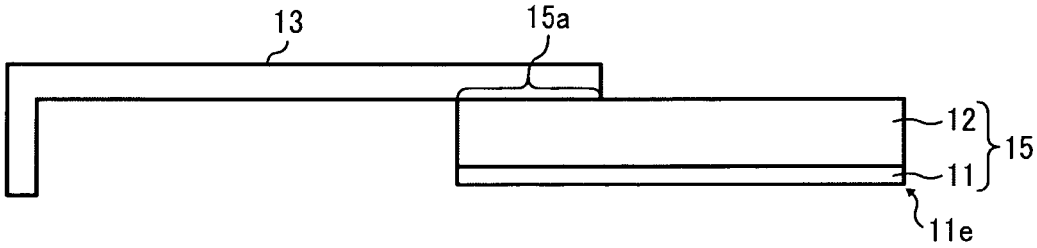
FIG. 1 BACKGROUND ART
FIG. 1 is a diagram of a background example of a blade holder and a double-layer laminated blade member.

It will be understood that if an element or layer is referred to as being "on", "against", "connected to" or "coupled to" another element or layer, then it can be directly on, against, connected or coupled to the other element or layer, or intervening elements or layers may be present. In contrast, if an element is referred to as being "directly on", "directly connected to" or "directly coupled to" another element or layer, then there are no intervening elements or layers present. Like numbers referred to like elements throughout. As used herein, the term "and/or" includes any and all combinations of one or more of the associated listed items.

Spatially relative terms, such as "beneath", "below", "lower", "above", "upper" and the like may be used herein for ease of description to describe one element or feature's relationship to another element(s) or feature(s) as illustrated in the figures. It will be understood that the spatially relative terms are intended to encompass different orientations of the device in use or operation in addition to the orientation depicted in the figures. For example, if the device in the figures is turned over, elements describes as "below" or "beneath" other elements or features would then be oriented "above" the other elements or features. Thus, term such as "below" can encompass both an orientation of above and below. The device may be otherwise oriented (rotated 90 degrees or at other orientations) and the spatially relative descriptors herein interpreted accordingly.

Although the terms first, second, etc. may be used herein to describe various elements, components, regions, layers and/or sections, it should be understood that these elements, components, regions, layer and/or sections should not be limited by these terms. These terms are used only to distinguish one element, component, region, layer or section from another region, layer or section. Thus, a first element, component, region, layer or section discussed below could be termed a second element, component, region, layer or section without departing from the teachings of the present invention.

The terminology used herein is for the purpose of describing particular embodiments only and is not intended to be limiting of the present invention. As used herein, the singular forms "a", "an" and "the" are intended to include the plural forms as well, unless the context clearly indicates otherwise. It will be further understood that the terms "includes" and/or "including", when used in this specification, specify the presence of stated features, integers, steps, operations, elements, and/or components, but do not preclude the presence or addition of one or more other features, integers, steps, operations, elements, components, and/or groups thereof.

Descriptions are given, with reference to the accompanying drawings, of examples, exemplary embodiments, modification of exemplary embodiments, etc., of an image forming apparatus according to the present invention. Elements having the same functions and shapes are denoted by the same reference numerals throughout the specification and redundant descriptions are omitted. Elements that do not require descriptions may be omitted from the drawings as a matter of convenience. Reference numerals of elements extracted from the patent publications are in parentheses so as to be distinguished from those of exemplary embodiments of the present invention.

The present invention includes a technique applicable to any image forming apparatus, and is implemented in the most effective manner in an electrophotographic image forming apparatus.

In describing preferred embodiments illustrated in the drawings, specific terminology is employed for the sake of clarity. However, the disclosure of the present invention is not intended to be limited to the specific terminology so selected and it is to be understood that each specific element includes all technical equivalents that operate in a similar manner.

Referring now to the drawings, wherein like reference numerals designate identical or corresponding parts throughout the several views, preferred embodiments of the present invention are described.

Figure 2:
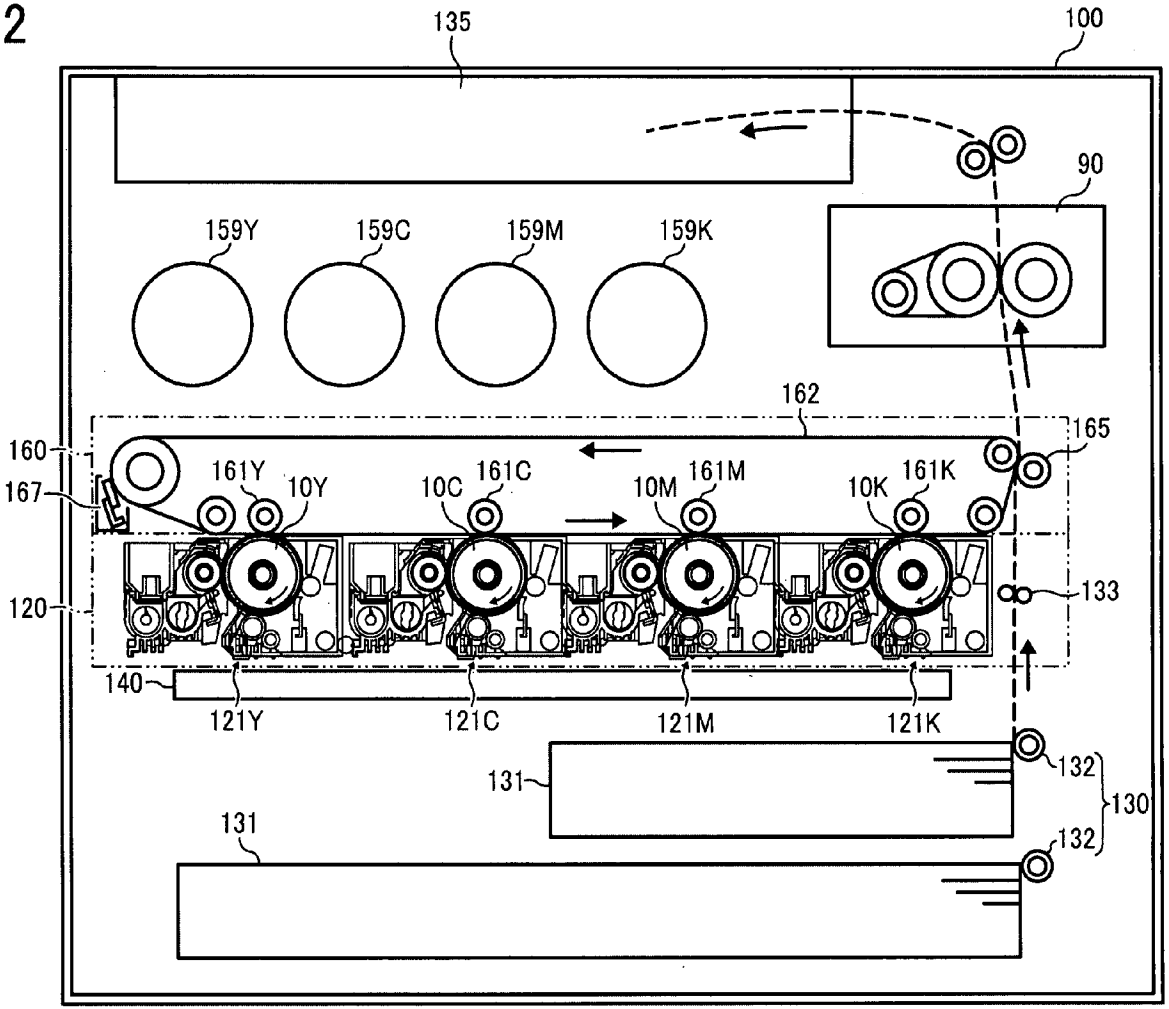
FIG. 2 is a schematic configuration diagram of a printer according to an embodiment of the present invention.

FIG. 2 is a schematic configuration diagram illustrating a printer 100 as the image forming apparatus according to the present embodiment. The printer 100 forms a full-color image, and mainly includes an image forming unit 120, a secondary transfer device 160, and a sheet feeding unit 130. In the following description, suffixes Y, C, M, and K represent members for yellow, cyan, magenta, and black colors, respectively.

The image forming unit 120 includes process cartridges 121Y, 121C, 121M, and 121K for yellow, cyan, magenta, and black toners, respectively, which are arranged in this order from the left side of the drawing. The process cartridges 121Y, 121C, 121M, and 121K (hereinafter occasionally collectively referred to as the process cartridges 121) are arranged in a line in a substantially horizontal direction. The process cartridges 121Y, 121C, 121M, and 121K include drum-like photoconductors 10Y, 10C, 10M, and 10K (hereinafter occasionally collectively referred to as the photoconductors 10), respectively, each serving as a latent image carrying member, which is an image carrying member having a moving surface.

The secondary transfer device 160 mainly includes a circular intermediate transfer belt 162, which is an intermediate transfer member stretched over multiple support rollers, primary transfer rollers 161Y, 161C, 161M, and 161K (hereinafter occasionally collectively referred to as the primary transfer rollers 161), and a secondary transfer roller 165. The intermediate transfer belt 162 is provided above the process cartridges 121, and extends along the moving direction of the respective surfaces of the photoconductors 10. A surface of the intermediate transfer belt 162 moves in synchronization with the movement of the respective surfaces of the photoconductors 10. Further, the primary transfer rollers 161 are arranged on the side of the inner circumferential surface of the intermediate transfer belt 162. The primary transfer rollers 161 bring the lower side of the outer circumferential surface (i.e., outer surface) of the intermediate transfer belt 162 into weak pressure contact with the outer circumferential surface (i.e., outer surface) of each of the photoconductors 10.

The process cartridges 121 are substantially the same in configuration and operation of forming a toner image on the photoconductor 10 and transferring the toner image onto the intermediate transfer belt 162. The primary transfer rollers 161Y, 161C, and 161M corresponding to three process cartridges for a color image, i.e., the process cartridges 121Y, 121C, and 121M are provided with a not-illustrated swing mechanism that vertically swings the primary transfer rollers 161Y, 161C, and 161M. The swing mechanism operates to prevent the intermediate transfer belt 162 from coming into contact with the photoconductors 10Y, 10C, and 10M when a color image is not formed.

The secondary transfer device 160 serving as an intermediate transfer unit is removably installable in the body of the printer 100. Specifically, a front cover provided on the near side of FIG. 2 to cover the image forming unit 120 of the printer 100 is opened, and the secondary transfer device 160 is slid from the far side toward the near side of FIG. 2. Thereby, the secondary transfer device 160 can be detached from the body of the printer 100. To attach the secondary transfer device 160 to the body of the printer 100, an operation reverse to the detaching operation is performed.

At a position on the intermediate transfer belt 162 downstream of the secondary transfer roller 165 and upstream of the process cartridge 121Y in the surface moving direction of the intermediate transfer belt 162, an intermediate transfer belt cleaning device 167 is provided to remove foreign matter, such as residual toner remaining after the secondary transfer operation, adhering to the intermediate transfer belt 162. The intermediate transfer belt cleaning device 167 supported integrally with the intermediate transfer belt 162 is removably installable in the body of the printer 100 as a part of the secondary transfer device 160.

Above the secondary transfer device 160, toner cartridges 159Y, 159C, 159M, and 159K corresponding to the process cartridges 121Y, 121C, 121M, and 121K, respectively, are arranged in a line in a substantially horizontal direction. Below the process cartridges 121Y, 121C, 121M, and 121K, an exposure device 140 is provided that applies laser light to the charged surface of each of the photoconductors 10Y, 10C, 10M, and 10K to form an electrostatic latent image thereon. Below the exposure device 140, the sheet feeding unit 130 is provided. The sheet feeding unit 130 includes sheet feeding cassettes 131 for storing transfer sheets serving as recording media and sheet feeding rollers 132. The sheet feeding unit 130 feeds each transfer sheet at predetermined timing toward a secondary transfer nip portion, which is formed between the intermediate transfer belt 162 and the secondary transfer roller 165, via a registration roller pair 133. On the downstream side of the secondary transfer nip portion in the transfer sheet conveying direction, a fixing device 90 is provided. On the downstream side of the fixing device 90 in the transfer sheet conveying direction, sheet discharging rollers and a discharged sheet storing unit 135 that stores a discharged transfer sheet are provided.

Figure 3:
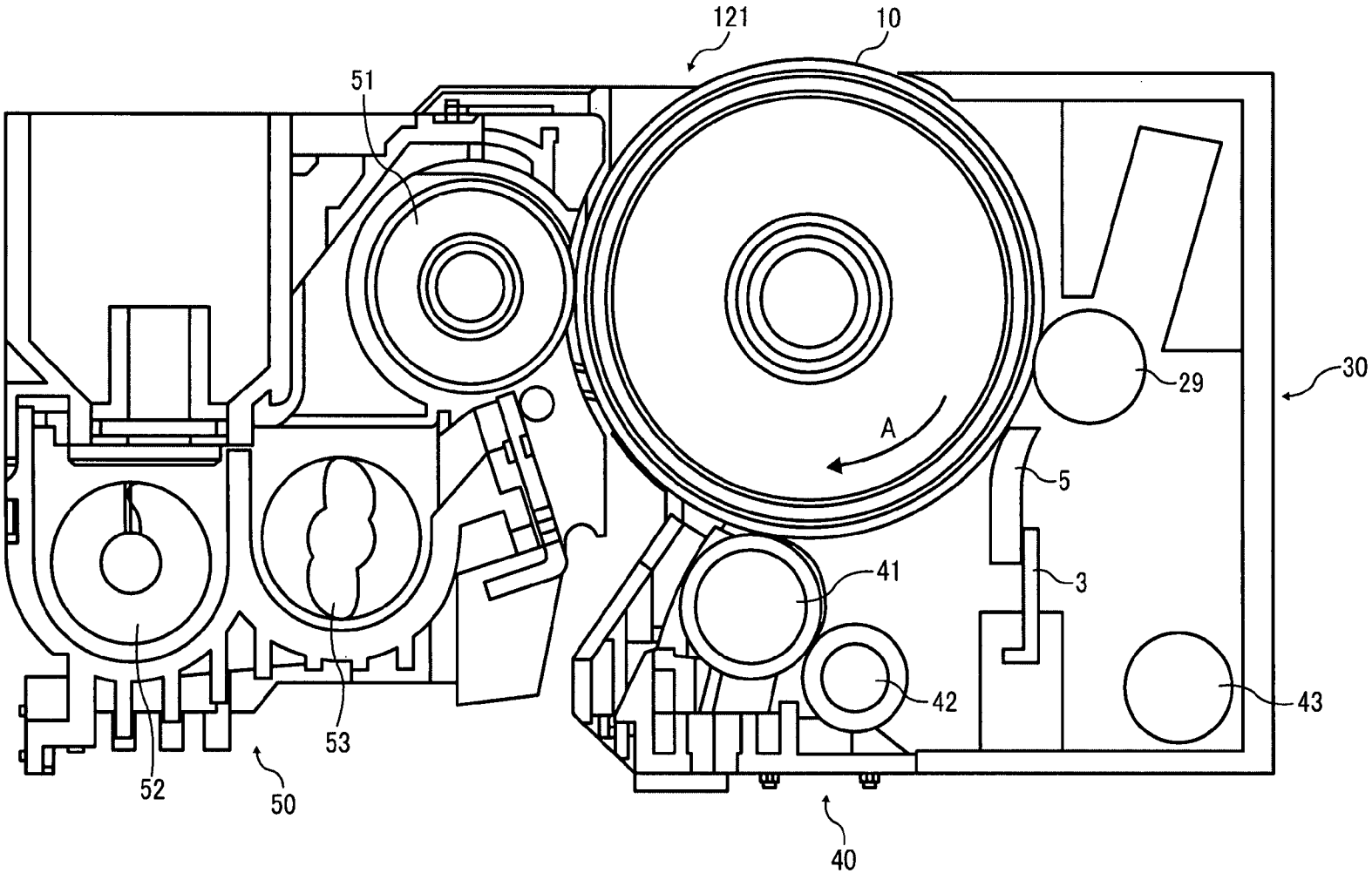
FIG. 3 is a schematic configuration diagram of a process cartridge provided in the printer.

FIG. 3 is a schematic configuration diagram illustrating one of the process cartridges 121 provided in the printer 100. Herein, the process cartridges 121 are substantially similar in configuration. In the following, therefore, a description will be given of the configuration and operation of the process cartridge 121, with the suffixes Y, C, M, and K for identifying the colors omitted. The process cartridge 121 includes the photoconductor 10, and a cleaning device 30, a charging device 40, and a development device 50 arranged around the photoconductor 10.

The cleaning device 30 includes a blade holder 3, a blade member 5, which is an elastic member extending in the direction of the rotation axis of the photoconductor 10, a brush roller 29, and a discharge screw 43. In the cleaning device 30, a side (i.e., a contact side) of the blade member 5 extending in the longitudinal direction thereof, which forms an edge portion, is pressed against the surface of the photoconductor 10 to scrape off and remove unnecessary foreign matter, such as post-transfer residual toner, adhering to the surface of the photoconductor 10. Then, the brush roller 29 sweeps the foreign matter away toward the discharge screw 43 from the upstream side of the contact position of the blade member 5 in contact with the photoconductor 10 in the surface moving direction of the photoconductor 10, and the discharge screw 43 discharges the foreign matter to the outside of the cleaning device 30. In the present embodiment, conductive PET (polyethylene terephthalate) is used as a fiber material forming the brush roller 29. Detailed description of the cleaning device 30 will be given later.

The cleaning device 30 may include a lubricant application device. The lubricant application device may include a solid lubricant, a lubricant support member that supports the solid lubricant, and the brush roller 29 that rotates while in contact with both the solid lubricant and the photoconductor 10. In this type of lubricant application device, the brush roller 29 scrapes the solid lubricant into powder and applies the powdered lubricant to the surface of the photoconductor 10. Further, in the lubricant application device to apply the lubricant to the surface of the photoconductor 10 by using the brush roller 29, an application blade may be provided downstream of the brush roller 29 in the surface moving direction of the photoconductor 10 to come into contact with the surface of the photoconductor 10. The application blade, which is supported by an application blade holder such that a leading end portion of the application blade is in contact with the surface of the photoconductor 10, levels the lubricant applied to the surface of the photoconductor 10 into a uniform thickness.

The charging device 40 mainly includes a charging roller 41 arranged to be in contact with the photoconductor 10 and a charging roller cleaner 42 that rotates while in contact with the charging roller 41.

The development device 50 supplies toner to the surface of the photoconductor 10, so as to visualize the electrostatic latent image formed on the surface of the photoconductor 10, and mainly includes a development roller 51, a mixing screw 52, and a supplying screw 53. The development roller 51 serves as a developer carrying member that carries a developer on a surface thereof. The mixing screw 52 conveys the developer contained in a developer container while mixing the developer. The supplying screw 53 conveys the mixed developer while supplying the developer to the development roller 51.

Each of the four process cartridges 121 having the above-described configuration can be independently attached, detached, and replaced by a service technician or a user. Further, the process cartridge 121 detached from the printer 100 allows each of the photoconductor 10, the charging device 40, the development device 50, and the cleaning device 30 to be independently replaced with a new replacement member. The process cartridge 121 may include a waste toner tank for collecting the post-transfer residual toner collected by the cleaning device 30. In this case, if the process cartridge 121 allows the waste toner tank to be independently attached, detached, and replaced, convenience is improved.

Subsequently, the operation of the printer 100 will be described. Upon receipt of a print instruction from an external device, such as a not-illustrated operation panel or personal computer, the printer 100 first rotates the photoconductor 10 in the direction indicated by an arrow A in FIG. 3, and causes the charging roller 41 of the charging device 40 to uniformly charge the surface of the photoconductor 10 to a predetermined polarity. The respective charged photoconductors 10 are then applied by the exposure device 140 with, for example, laser beams for the respective colors optically modulated in accordance with input color image data. Thereby, electrostatic latent images corresponding to the respective colors are formed on the respective surfaces of the photoconductors 10. Each of the electrostatic latent images is supplied with a developer of the corresponding color from the development roller 51 of the development device 50 for the color. Thereby, the electrostatic latent images corresponding to the respective colors are developed by the developers of the respective colors and visualized as toner images corresponding to the respective colors. Then, the primary transfer rollers 161 are applied with a transfer voltage opposite in polarity to the toner images. Thereby, a primary transfer electric field is formed between the photoconductors 10 and the primary transfer rollers 161 via the intermediate transfer belt 162. Further, the primary transfer rollers 161 bring the intermediate transfer belt 162 into weak pressure contact with the photoconductors 10 to form respective primary transfer nips. Due to the above-described functions, the respective toner images on the photoconductors 10 are efficiently primarily transferred onto the intermediate transfer belt 162. Consequently, the toner images of the respective colors formed on the photoconductors 10 are transferred onto the intermediate transfer belt 162 to be superimposed on one another, and a laminated toner image is formed.

By contrast, a transfer sheet stored in one of the sheet feeding cassettes 131 is fed at predetermined timing by the corresponding sheet feeding roller 132, the registration roller pair 133, and so forth. Then, a transfer voltage opposite in polarity to the laminated toner image primarily transferred onto the intermediate transfer belt 162 is applied to the secondary transfer roller 165, forming a secondary transfer electric field between the intermediate transfer belt 162 and the secondary transfer roller 165 via the transfer sheet by which the laminated toner image is transferred onto the transfer sheet. The transfer sheet having the laminated toner image transferred thereto is then conveyed to the fixing device 90, and the toner image is fixed on the transfer sheet with heat and pressure. The transfer sheet having the toner image fixed thereon is discharged to and placed on the discharged sheet storing unit 135 by the sheet discharging rollers. Meanwhile, post-transfer residual toner remaining on each of the photoconductors 10 after the primary transfer operation is scrapped off and removed by the blade member 5 of the corresponding cleaning device 30.

A detailed description will now be given of an example of the cleaning device 30 according to the present invention.

Figure 4:
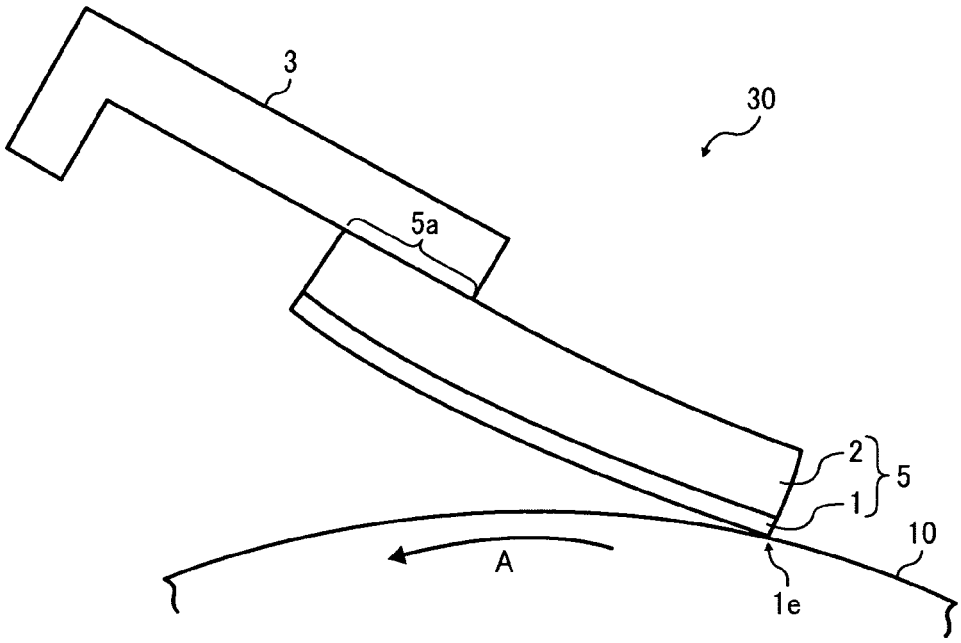
FIG. 4 is a diagram of a portion of a blade member of a cleaning device according to an embodiment of the present invention in contact with a photoconductor.

FIG. 4 is a diagram illustrating a portion of the blade member 5 of the cleaning device 30 in contact with the photoconductor 10, as viewed from the rotation axis of the photoconductor 10. The cleaning device 30 includes the laminated blade member 5 using, as a cleaning blade, an elastic member including multiple layers, and the blade holder 3 holding one end of the blade member 5. The blade member 5 includes, as the multiple layers, an edge layer 1 and a backing layer 2 made of materials mutually different in permanent set value. The edge layer 1 corresponds to a layer in contact with the photoconductor 10 as a cleaning target, and the backing layer 2 corresponds to a layer located on the rear side of the edge layer 1. Further, the cleaning device 30 cleans the surface of the photoconductor 10 by bringing an edge portion 1*e*, which forms an end portion of the blade member 5 opposite to a holding position 5*a* held by the blade holder 3 into contact with the surface of the photoconductor 10 moving in the direction indicated by arrow A in FIG. 4. The edge layer 1 including the edge portion 1*e* is made of a material higher in permanent set value than the material of the backing layer 2.

Figure 5:
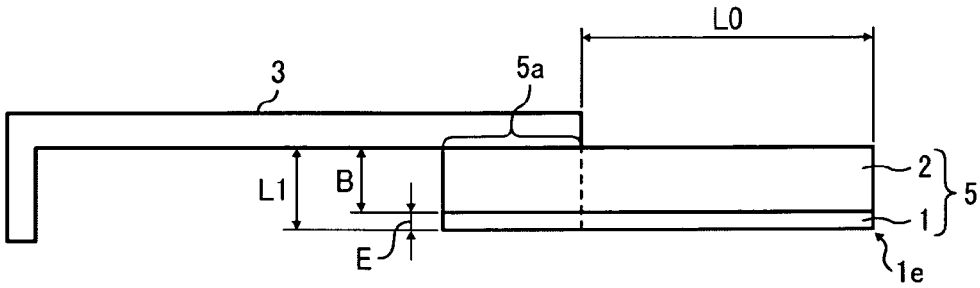
FIG. 5 is a diagram of the blade member and a blade holder included in the cleaning device according to the embodiment.

FIG. 5 is a diagram of the blade member 5 and the blade holder 3 illustrated in FIG. 4. In FIG. 5, E represents the thickness of the edge layer 1, and B represents the thickness of the backing layer 2. Further, L0 represents the free length between the leading end of the blade member 5 and a leading edge of the holding position 5*a*, and L1 represents the total thickness of the blade member 5.

The edge layer 1 uses a material relatively high in permanent set value and 100% modulus value, and the backing layer 2 uses a material lower in permanent set value and 100% modulus value than the material of the edge layer 1. Further, in the laminated blade member 5 formed by the combination of the edge layer 1 and the backing layer 2, the respective thicknesses of the edge layer 1 and the backing layer 2 are adjusted as appropriate, such that the blade member 5 installed in the cleaning device 30 has a linear pressure reduction rate of approximately 90% or higher. Further, in the setting of a penetration amount "d" (mm), a contact pressure "f" (g/cm), a contact angle "α" (° or degrees), and so forth of the blade member 5 with respect to the photoconductor 10, physical properties of the materials forming the blade member 5 combining the edge layer 1 and the backing layer 2 may be measured, and the setting may be performed on the basis of the measured physical properties. For example, the penetration amount d, the contact pressure f, and the contact angle α may be set to respective appropriate values in ranges of $0<d<1.5$, $10\leqq f\leqq 80$, and $5\leqq \alpha\leqq 25$, respectively. Specific embodiment examples of the double-layer blade member 5 include Blades 6 to 9 and Blades 12 to 14 presented in an experiment described later.

As described above, the edge layer 1 in contact with the photoconductor 10 uses a material relatively high in hardness and 100% modulus value. This is because such a material, when brought into contact with the photoconductor 10, is capable of providing relatively high peak pressure necessary for blocking contemporary toner including small-diameter highly spherical toner particles, without unnecessarily increasing the nip width. Further, with the use of a material relatively high in hardness and 100% modulus value, variations in nip width are small and variations in contact pressure and peak pressure are suppressed against variations in frictional force generated between the blade member 5 and the photoconductor 10 due to variations in image pattern. Accordingly, variations in cleaning performance are suppressed, and stable cleaning performance is maintained.

Meanwhile, the backing layer 2 uses a material lower in hardness, 100% modulus value, and permanent set value than the material of the edge layer 1. In a blade member made solely of a material relatively high in hardness, 100% modulus value, and permanent set value, which is suitable for use in the edge layer 1, the blade member loses resilience and thus fails to maintain stable linear pressure due to the elapsed time or environmental change. Meanwhile, the blade member 5 uses, in the backing layer 2, a material relatively low in hardness, 100% modulus value, and permanent set value and thereby suppress the loss of resilience occurring in the entire blade member 5. If the edge layer 1 in contact with the photoconductor 10 uses a material having a permanent set value of approximately 2% or higher and a relatively high 100% modulus value, and if the backing layer 2 uses a material having a permanent set value of approximately 2% or lower, the blade member 5 is capable of maintaining favorable cleaning performance for cleaning off polymerized toner including small-diameter spherical toner particles for a relatively long time from the initial state, without losing resilience.

Subsequently, a description will be given of an experiment.

In the present experiment, multiple blade members having different configurations were prepared, and each of the blade members was kept in contact with a photoconductor for a predetermined period of time to examine the degree of reduction in linear pressure over time from the initial linear pressure. TABLE 1 (A and B) lists the respective configurations of Blades 1 to 14, which are fourteen different types of blade members used in the experiment.

TABLE 1

TABLE 1A

| BLADE NO. | CONFIGURATION | MATERIAL | 100% M (MPa) | PERMANENT SET (%) |
|---|---|---|---|---|
| 1 | Single | A | 3.5 | 0.95 |
| 2 | Single | B | 5.3 | 2.1 |
| 3 | Single | C | 5.9 | 2.3 |
| 4 | Single | D | 7.5 | 2.86 |
| 5 | Single | E | 12 | 4.9 |
| 6 | Double | C + G | — | — |
| 7 | Double | D + G | — | — |
| 8 | Double | F + J | — | — |
| 9 | Double | F + H | — | — |
| 10 | Double | E + I | — | — |
| 11 | Double | E + J | — | — |

TABLE 1-continued

| | | | | |
|---|---|---|---|---|
| 12 | Double | E + H | — | — |
| 13 | Double | E + K | — | — |
| 14 | Double | E + L | — | — |

TABLE 1B

| | EDGE LAYER | | | BACKING LAYER | | | |
|---|---|---|---|---|---|---|---|
| BLADE NO. | MATE-RIAL | 100% M (MPa) | PERM. SET (%) | MATE-RIAL | 100% M (MPa) | PERM. SET (%) | LINEAR PRESSURE |
| 1 | — | — | — | — | — | — | 93.7 |
| 2 | — | — | — | — | — | — | 91 |
| 3 | — | — | — | — | — | — | 88 |
| 4 | — | — | — | — | — | — | 84 |
| 5 | — | — | — | — | — | — | 75 |
| 6 | C | 5.9 | 2.3 | G | 3.5 | 1.2 | 91.1 |
| 7 | D | 7.5 | 2.86 | G | 3.5 | 1.2 | 90.1 |
| 8 | F | 10 | 4.3 | J | 4.3 | 0.92 | 90.2 |
| 9 | F | 10 | 4.3 | H | 2.3 | 0.32 | 90.7 |
| 10 | E | 12 | 4.9 | I | 6.1 | 1.59 | 80.5 |
| 11 | E | 12 | 4.9 | J | 4.3 | 0.92 | 81.9 |
| 12 | E | 12 | 4.9 | H | 2.3 | 0.32 | 89.7 |
| 13 | E | 12 | 4.9 | K | 2.2 | 0.2 | 90.5 |
| 14 | E | 12 | 4.9 | L | 2.2 | 0.05 | 91.2 |

Herein, "Single" and "Double" in the column of CONFIGURATION represent the single-layer structure and the double-layer structure, respectively. Blades 1 to 5 in TABLE 1, each of which is a single-layer blade member entirely uniform in rubber material composition, are blade members having a thickness of approximately 1.8 mm and a free length of approximately 7.2 mm. Further, Blades 6 and 14, each of which is a double-layer blade member used in the present experiment, are blade members with the layer thickness E of the edge layer 1, the layer thickness B of the backing layer 2, the total thickness L1 of the entire blade member 5, and the free length L0 illustrated in FIG. 5 set to approximately 0.5 mm, approximately 1.3 mm, approximately 1.8 mm, and approximately 7.2 mm, respectively.

Blade 1 is a background blade member that has been used to clean off deformed toner including toner particles having a relatively low sphericity of approximately 0.96 and a particle diameter of approximately 5 μm to approximately 6 μm.

To obtain higher cleaning performance for cleaning off small-diameter highly spherical toner particles than the cleaning performance of Blade 1, Blades 2 to 5 are formed as blade members using, in the respective single layers thereof, materials B, C, D, and E, respectively, that are relatively high in hardness and 100% modulus value and effective in increasing the peak pressure and the contact pressure in a contact region between the blade member 5 and the photoconductor 10.

Blades 6 to 11 are double-layer blade members using, in the respective edge layers 1, materials C, D, F, F, E, and E, respectively, which are relatively high in hardness and 100% modulus value, and using, in the respective backing layers 2, materials lower in hardness, 100% modulus value, and permanent set value than the materials of the edge layers 1.

Herein, an increase in the 100% modulus value results in a reduction in the amount of deformation of a blade leading end ridgeline portion (i.e., the edge portion 1*e*) caused by frictional force acting between the blade member 5 and the photoconductor 10, and is effective in increasing the contact pressure and the peak pressure without unnecessarily increasing the nip width. The increase in the 100% modulus value also provides an advantage in suppressing variations in nip width and allowing stable maintenance of the contact pressure and the peak pressure against variations in frictional force generated between the blade member 5 and the photoconductor 10 due to variations in image pattern. Meanwhile, an increase in the permanent set value of a material forming the blade member 5 results in an increase in the loss of resilience of the blade member 5, and causes a reduction in pressure over time.

As for the linear pressure reduction rate (%) in TABLE 1 described above, the linear pressure is continuously measured for 160 hours for each of Blades 1 to 14 installed in the process cartridge 121, i.e., an AIO (All-In-One) photoconductor unit capable of actually performing an image forming operation, as the blade member 5, immediately after the installation of the blade. The linear pressure reduction rate represents the degree of change in the linear pressure measured after the lapse of 160 hours with respect to the linear pressure measured immediately after the installation of the blade. Specifically, the linear pressure reduction rate is represented by the value calculated as (linear pressure measured after the lapse of 160 hours)/(initial linear pressure)×100. The linear pressure reduction rate of the blade is measured with the blade installed in a photoconductor unit using the blade. It is therefore possible to perform similar evaluation by installing the blade in a photoconductor unit different in configuration from the photoconductor unit of the present embodiment.

Further, in Blade 1 that has been used in the past, the reduction in linear pressure was sufficiently saturated after the lapse of 160 hours immediately after the installation of the blade. In the use of Blade 1 in an actual office environment, therefore, a trouble such as cleaning failure due to the loss of resilience does not occur in the blade. It is therefore assumed that, if any of Blades 2 to 14 is equal to Blade 1 in the linear pressure reduction rate measured after the lapse of 160 hours, the cleaning failure due to the loss of resilience does not occur in the blade, and that a reduction in pressure due to the loss of resilience and resultant deterioration of the cleaning performance do not occur in the blade when used in an actual office environment.

Figure 6:
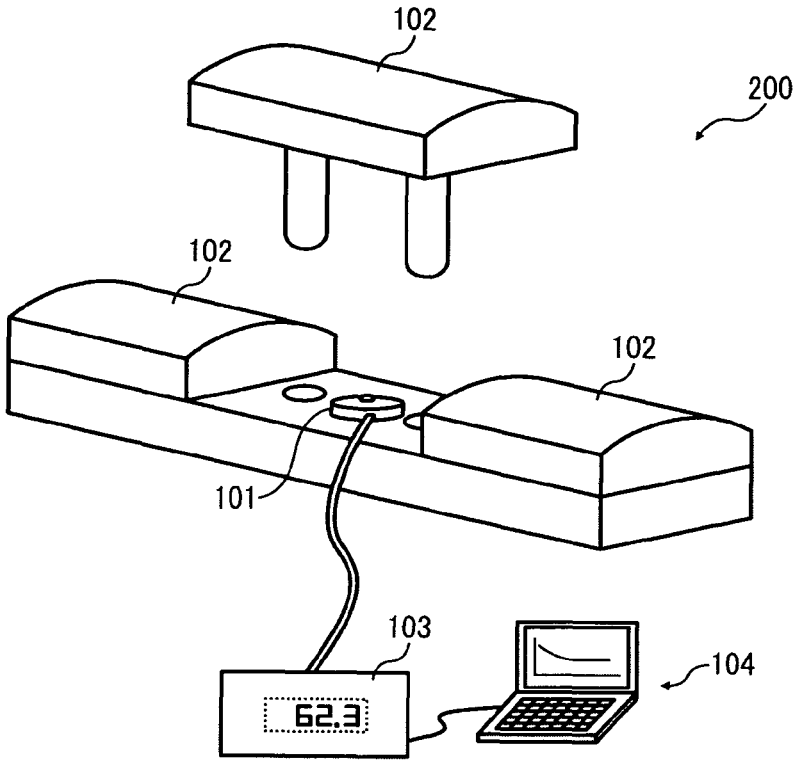
FIG. 6 is a perspective explanatory view of a measurement device.
Figure 7:
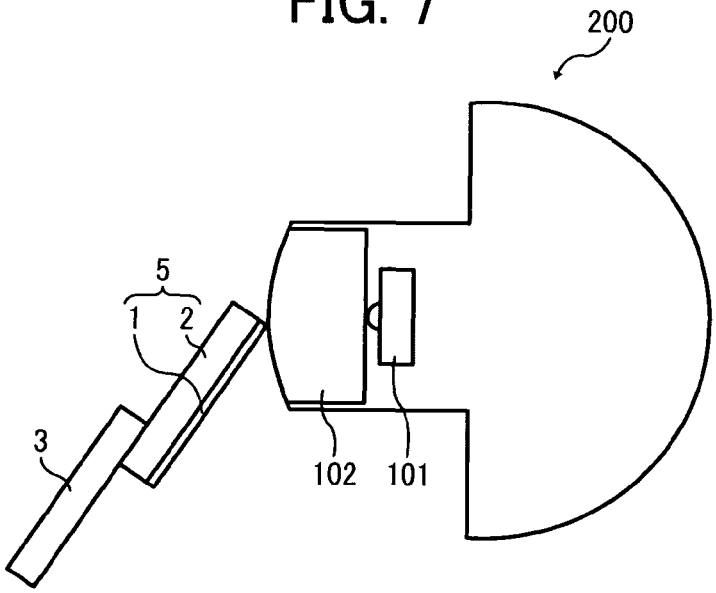
FIG. 7 is a side explanatory view of the measurement device.

FIGS. 6 and 7 are explanatory diagrams of a measurement device 200 that measures the liner pressure. The measurement device 200, which measures the liner pressure generated by the contact of a blade in the installed state, has a diameter corresponding to the diameter of the photoconductor 10, and includes a pad 102 provided at a location that comes into contact with the edge layer 1 of the blade member 5. The pad 102 is divided into three sections in the longitudinal direction thereof, and transmits the acting force of the blade member 5 to a load cell 101, which is provided to each of the three sections of the pad 102 to be in contact therewith. The load cell 101 may be, for example, a load cell LMA-A-10N manufactured by Kyowa Electronic Instruments Co., Ltd. The measurement device 200 further includes a panel 103 for displaying the force acting on the load cell 101. The panel 103 may be, for example, an instrumentation panel WGA-650 manufactured by Kyowa Electronic Instruments Co., Ltd. Further, a logger 104 for logging with a personal computer is prepared to chronologically record measurement values measured by the load cell 101. Each of the blades is installed in the measurement device 200 in a layout based on practical usage. As for the recorded measurement values, the initial value, i.e., the measurement value measured after the installation of the blade in the measurement device 200 is compared with the measurement value measured after the lapse of a predetermined time. Thereby, the reduction rate of the linear pressure is calculated. In the illustrated example, the pad 102 used for the measurement is divided into three sections. However, the number of divided sections of the pad 102 may be arbitrarily determined.

Blades 1 to 14 listed in TABLE 1 were evaluated for deformed toner cleaning performance and spherical toner cleaning performance. The results of the evaluation are listed in TABLE 2 (A and B).

TABLE 2

TABLE 2A

| BLADE NO. | CONFIGURATION | MATERIAL | DEFORMED TONER LOW μ INITIAL STATE | DEFORMED TONER HIGH μ INITIAL STATE | DEFORMED TONER LOW μ 80K STATE | DEFORMED TONER HIGH μ 80K STATE |
|---|---|---|---|---|---|---|
| 1 | Single | A | VERY GOOD | GOOD | VERY GOOD | GOOD |
| 2 | Single | B | VERY GOOD | VERY GOOD | VERY GOOD | GOOD |
| 3 | Single | C | VERY GOOD | VERY GOOD | VERY GOOD | VERY GOOD |
| 4 | Single | D | — | — | — | — |
| 5 | Single | E | — | — | — | — |
| 6 | Double | C + G | — | — | — | — |
| 7 | Double | D + G | — | — | — | — |
| 8 | Double | F + J | — | — | — | — |
| 9 | Double | F + H | — | — | — | — |
| 10 | Double | E + I | — | — | — | — |
| 11 | Double | E + J | — | — | — | — |
| 12 | Double | E + H | — | — | — | — |
| 13 | Double | E + K | — | — | — | — |
| 14 | Double | E + L | — | — | — | — |

TABLE 1B

| BLADE NO. | SPHERICAL TONER LOW μ INITIAL STATE | SPHERICAL TONER HIGH μ INITIAL STATE | SPHERICAL TONER LOW μ 80K STATE | SPHERICAL TONER HIGH μ 80K STATE |
|---|---|---|---|---|
| 1 | POOR | POOR | POOR | POOR |
| 2 | POOR | POOR | POOR | POOR |
| 3 | GOOD | GOOD | POOR | POOR |
| 4 | VERY GOOD | GOOD | POOR | POOR |
| 5 | VERY GOOD | VERY GOOD | POOR | POOR |
| 6 | GOOD | GOOD | GOOD | GOOD |
| 7 | VERY GOOD | GOOD | VERY GOOD | GOOD |
| 8 | VERY GOOD | VERY GOOD | VERY GOOD | VERY GOOD |
| 9 | VERY GOOD | VERY GOOD | VERY GOOD | VERY GOOD |
| 10 | VERY GOOD | VERY GOOD | POOR | POOR |
| 11 | VERY GOOD | VERY GOOD | POOR | POOR |
| 12 | VERY GOOD | VERY GOOD | GOOD | GOOD |
| 13 | VERY GOOD | VERY GOOD | VERY GOOD | VERY GOOD |
| 14 | VERY GOOD | VERY GOOD | VERY GOOD | VERY GOOD |

"Single" and "Double" in the column of CONFIGURATION represent the single-layer structure and the double-layer structure, respectively. In TABLE 2A, DEFORMED TONER represents polymerized toner including toner particles having a sphericity of approximately 0.96 and a particle diameter of approximately 6 μm, and SPHERICAL TONER represents polymerized toner including toner particles having a sphericity of approximately 0.98 or higher and a particle diameter of approximately 4 μm.

Further, in the present experiment, a lubricant was applied to the surface of a photoconductor. An increase in the amount of toner used in the image formed on the photoconductor results in an increase in the amount of the lubricant mixed into the toner and an increase in a friction coefficient "μ" between the blade and the photoconductor. Meanwhile, a reduction in the amount of toner on the photoconductor results in a reduction in consumption of the lubricant and a reduction in the friction coefficient μ. Further, LOW μ in TABLE 2 represents a condition under that a longitudinal band-like 5% chart image is continuously input. The amount of input toner is normal. Thus, the frictional force acting between the blade and the photoconductor is normal. There is little variation in frictional force in the longitudinal direction. Meanwhile, HIGH μ in TABLE 2 represents a condition under that a longitudinal band-like 20% chart image is continuously input. The amount of input toner is relatively large. Thus, the frictional force acting between the blade and the photoconductor is increased. Under this condition, the frictional force substantially varies in the longitudinal direction, and the cleaning performance tends to be deteriorated.

Description will now be made of the respective 100% modulus values, permanent set values, and linear pressure reduction rates of the blades listed in TABLE 1 and the evaluation results of the cleaning performance listed in TABLE 2. In the evaluations of the cleaning performance listed in TABLE 2, the sheet feeding operation was performed from the initial state to the 80K state, i.e., until the feeding of the 80,000th sheet, under the low μ condition corresponding to the continuous input of the longitudinal band-like 5% chart image and the high μ condition corresponding to the continuous input of the longitudinal band-like 20% chart image. Then, the cleaning performance was classified into groups of "VERY GOOD", "GOOD", and "POOR" on the basis of the cleaning failure occurring in the sheets and the amount of residual toner remaining on the surface of the photoconductor. "VERY GOOD" indicates that there is no cleaning failure visible in a sheet, and that there is no residual toner remaining on the surface of the photoconductor. "GOOD" indicates that there is no cleaning failure visible in a sheet, and that there is residual toner remaining on the surface of the photoconductor. "POOR" indicates that there is a cleaning failure visible in a sheet, and that there is residual toner remaining on the surface of the photoconductor. As for the types of toner, the evaluation was performed on two types of toner, i.e., the deformed toner and the spherical toner. In the initial state, a thousand sample sheets from the 1st to 1,000th fed sheets were evaluated for cleaning performance. In the 80K state, a thousand sample sheets from the 79,001st to 80,000th sheets of the 80,000 fed sheets were evaluated for cleaning performance.

The single-layer blades will be first described. Blade 1 is a blade member that has been used in the past for so-called deformed toner including toner particles having a sphericity of approximately 0.96 or lower and a particle diameter of approximately 5 μm to approximately 6 μm. The single-layer material A had a 100% modulus value of approximately 3.5 MPa (MegaPascals), a permanent set value of approximately 0.95%, and a linear pressure reduction rate of approximately 93.7%. As illustrated in TABLE 2, Blade 1 exhibits favorable deformed toner cleaning performance, as indicated as "VERY GOOD", under the low μ condition in the initial state and the 80K state. Further, under the high μ condition, Blade 1 exhibits "GOOD" cleaning performance both in the initial state and the 80K state, presumably due to a reduction in the peak pressure and resultant deterioration of the cleaning performance under the high μ condition. As for the spherical toner cleaning performance, however, Blade 1 exhibits "POOR" cleaning performance, with the cleaning failure occurring in the blade in the low μ initial state. This is because Blade 1 has a relatively low 100% modulus value, and thus fails to obtain peak pressure necessary for cleaning off the spherical toner.

In Blade 2, the single-layer material B had a 100% modulus value of approximately 5.3 MPa, a permanent set value of approximately 2.1%, and a linear pressure reduction rate of approximately 91%. As compared with Blade 1, Blade 2 is deteriorated in the permanent set value. Thus, Blade 2 is also deteriorated in the linear pressure reduction rate. As illustrated in TABLE 2, however, Blade 2 exhibits favorable deformed toner cleaning performance in the low μ initial state and the low μ 80K state, as indicated as "VERY GOOD". Blade 2 also exhibits "VERY GOOD" deformed toner cleaning performance in the high μ initial state. This is because the peak pressure in the high μ initial state is maintained at a higher value than in Blade 1 due to an increase in the 100% modulus value. As for the spherical toner cleaning performance, however, Blade 2 exhibits "POOR" cleaning performance, with the cleaning failure occurring in the blade in the initial state, similarly as in Blade 1.

In Blade 3, the single-layer material C had a 100% modulus value of approximately 5.9 MPa, a permanent set value of approximately 2.3%, and a linear pressure reduction rate of approximately 88%. Blade 3 is higher in 100% modulus value than Blades 1 and 2, and exhibits "GOOD" spherical toner cleaning performance in the low μ initial state and the high μ initial state by producing acceptable images. This is because the peak pressure necessary for cleaning off the spherical toner was obtained with the 100% modulus value set to approximately 5.9 MPa. Meanwhile, in the 80K state, Blade 3 exhibits "POOR" spherical toner cleaning performance. As observed from the reduction in the linear pressure reduction rate to approximately 88%, this is because the increase in the 100% modulus value caused the deterioration of the permanent set value and so-called loss of resilience, and because the blade failed to maintain the initial peak pressure due to the loss of resilience. Meanwhile, Blade 3 exhibits "VERY GOOD" deformed toner cleaning performance in the 80K state, even with the linear pressure reduction rate of approximately 88%. It is therefore understood that Blade 3 is capable of sufficiently cleaning off the deformed toner, even if the peak pressure is reduced due to the loss of resilience.

In Blade 4, the single-layer material D had a 100% modulus value of approximately 7.5 MPa, a permanent set value of approximately 2.86%, and a linear pressure reduction rate of approximately 84%. Blade 4 is higher in permanent set value than Blade 3. Thus, the linear pressure reduction rate of the blade is deteriorated to approximately 84%. The spherical toner cleaning performance of Blade 4 is "VERY GOOD" in the low μ initial state, "GOOD" in the high μ initial state, and "POOR" in the low μ 80K state due to the loss of resilience.

In Blade 5, the single-layer material E had a 100% modulus value of approximately 12 MPa, a permanent set value of approximately 4.9%, and a linear pressure reduction rate of approximately 75%. In the initial state, Blade 5 exhibits favorable cleaning performance both under the low μ condition and the high μ condition, as indicated as "VERY GOOD". This is because, with the use of a material having a relatively high 100% modulus value, Blade 5 is capable of maintaining relatively high peak pressure without increasing the nip width even under the high μ condition. Blade 5, however, has the single-layer structure, and thus the linear pressure reduction rate thereof is substantially deteriorated to approximately 75% due to the loss of resilience. As a result, Blade 5 exhibits "POOR" cleaning performance even in the low μ 80K state.

It is understood from the above-described results of Blades 1 to 5 that it is desired to use materials having a 100% modulus value of approximately 5.9 MPa to approximately 12 MPa, which are capable of increasing the peak pressure, as the rubber material forming a portion of the blade member 5 in contact with the photoconductor 10 to ensure the spherical toner cleaning performance in the initial state such that the cleaning failure is invisible in a sheet. However, all of such materials have a linear pressure reduction rate of approximately 88% or lower. Thus, it is understood that the single-layer blades fail to maintain the peak pressure over time.

The double-layer blades will now be described. Blade 6 includes an edge layer made of the rubber material C having a 100% modulus value of approximately 5.9 MPa and a permanent set value of approximately 2.3% and a backing layer made of a rubber material G having a 100% modulus value of approximately 3.5 MPa and a permanent set value of approximately 1.2% in order to improve the linear pressure reduction rate of Blade 3. The linear pressure reduction rate of Blade 6 is approximately 91.1%, which is substantially improved as compared with the linear pressure reduction rate of Blade 3. Further, the cleaning performance of Blade 6 is "GOOD" in the low μ 80K state and the high μ 80K state. That is, the cleaning performance deteriorated by the loss of resilience is improved.

Blade 7 includes an edge layer made of the rubber material D having a 100% modulus value of approximately 7.5 MPa and a permanent set value of approximately 2.86% and a backing layer made of the rubber material G having a 100% modulus value of approximately 3.5 MPa and a permanent set value of approximately 1.2% in order to improve the linear pressure reduction rate of Blade 4. The linear pressure reduction rate of Blade 7 is approximately 90.1%, which is substantially improved as compared with the linear pressure reduction rate of Blade 4. Further, the cleaning performance of Blade 7 is "VERY GOOD" in the low μ 80K state and "GOOD" in the high μ 80K state. That is, the cleaning performance deteriorated by the loss of resilience is improved.

Blades 8 and 9 use, in the respective edge layers, a rubber material F having a 100% modulus value of approximately 10 MPa and a permanent set value of approximately 4.3%. Blade 8 uses, in the backing layer, a rubber material J having a 100% modulus value of approximately 4.3 MPa and a permanent set value of approximately 0.92%. Blade 9 uses, in the backing layer, a rubber material H having a 100% modulus value of approximately 2.3 MPa and a permanent set value of approximately 0.32%. Blades 8 and 9 have linear pressure reduction rates of approximately 90.2% and approximately 90.7%, respectively. Blades 8 and 9 both exhibit "VERY GOOD" cleaning performance in the low μ 80K state and the high μ 80K state, and the reduction in linear pressure due to the loss of resilience is cancelled. Blades 8 and 9 use, in the respective edge layers, a material higher in 100% modulus value than the material forming the edge layer of Blade 6. Accordingly, Blades 8 and 9 sufficiently maintain the peak pressure even under the high μ condition.

Blades 10, 11, 12, 13, and 14 use, in the respective edge layers, the rubber material E having a 100% modulus value of approximately 12 MPa and a permanent set value of approximately 4.9%. Further, Blades 10, 11, 12, 13, and 14 use, in the respective backing layers, five types of rubber materials I, J, H, K, and L, respectively, which are different in 100% modulus value and permanent set value. Each of the five types of blades was evaluated for the linear pressure reduction rate and the spherical toner cleaning performance.

In Blade 10, the permanent set value of the backing layer is approximately 1.59%, and the linear pressure reduction rate is approximately 80.5%. In Blade 11, the permanent set value of the backing layer is approximately 0.92%, and the linear pressure reduction rate is approximately 81.9%. In both Blades 10 and 11, the linear pressure reduction rate is substantially below 90%. Further, in the low μ 80K state and the high μ 80K state, Blades 10 and 11 exhibit "POOR" cleaning performance, with the cleaning failure occurring in the blades due to a reduction in pressure caused by the loss of resilience.

Blade 12 has a linear pressure reduction rate of approximately 89.7%, and exhibits "GOOD" cleaning performance in the low μ 80K state and the high μ 80K state.

Blades 13 and 14 have linear pressure reduction rates of approximately 90.5% and approximately 91.2%, respectively, and exhibit "VERY GOOD" cleaning performance in the low μ 80K state and the high μ 80K state.

On the basis of the above-described results of study of Blades 6 to 14 having the double-layer structure, a description will given of configurations capable of obtaining, over time from the initial state, favorable spherical toner cleaning performance.

On the basis of the results of study of Blades 6 and 7, in order to obtain at least "GOOD" spherical toner cleaning performance in the initial state and the 80K state, a rubber material having a 100% modulus value of approximately 5.9 MPa or higher is used in the edge layer. Further, if the 100% modulus value of the edge layer is increased to approximately 7.5 MPa to improve the cleaning performance to the "VERY GOOD" level in the low μ initial state and the low μ 80K state, at least "GOOD" cleaning performance is obtained in the 80K state by the backing layer to attain a linear pressure reduction rate of approximately 90.1% (or approximately 90%) or higher. That is, in order to obtain at least "GOOD" spherical toner cleaning performance in the initial state and the 80K state, a rubber material having a 100% modulus value of approximately 5.9 MPa or higher is used in the edge layer, and the backing layer attains a linear pressure reduction rate of approximately 90% or higher.

On the basis of the results of study of Blades 8 and 9, in order to obtain "VERY GOOD" spherical toner cleaning performance in each of the low μ initial state, the high μ initial state, the low μ 80K state, and the high μ 80K state, a rubber material having a 100% modulus value of approximately 10 MPa or higher is used in the edge layer, and the backing layer attains a linear pressure reduction rate of approximately 90% or higher. That is, in accordance with the 100% modulus value of the edge layer increased be higher than in Blades 6 and 7, the 100% modulus value of the backing layer is reduced, and a material having a lower permanent set value (approximately 0.92% or lower in the experiment) is used. Thereby, the blade attains a linear pressure reduction rate of approximately 90% or higher.

On the basis of the results of study of Blades 13 and 14, if a rubber material having a 100% modulus value of approximately 12 MPa is used in the edge layer, the backing layer attains a linear pressure reduction rate of approximately 90% or higher. Thereby, "VERY GOOD" cleaning performance is obtained in each of the low μ initial state, the high μ initial state, the low μ 80K state, and the high μ 80K state. Specifically, a material having a permanent set value of approximately 0.2% or lower is used in the backing layer.

Further, on the basis of the results of study of Blade 12, if a rubber material having a 100% modulus value of approximately 12 MPa is used in the edge layer, and if a material having a permanent set value of approximately 0.32% is used in the backing layer, at least "GOOD" cleaning performance is obtained in the low μ 80K state and the high μ 80K state, although the linear pressure reduction rate of the blade is approximately 89.7%, slightly below 90%.

Accordingly, in order to obtain at least "GOOD" cleaning performance in at least the initial state and over time, a rubber material having a 100% modulus value of approximately 5.9

MPa (or approximately 6.0 MPa) or higher is used in the edge layer, and the 100% modulus value and the permanent set value of the backing layer are selected such that a linear pressure reduction rate of approximately 89.7% (or approximately 90%) or higher is attained.

Further, in order to obtain "VERY GOOD" cleaning performance in the initial state and "GOOD" cleaning performance over time, a rubber material having a 100% modulus value of approximately 10 MPa or higher is used in the edge layer, and the 100% modulus value and the permanent set value of the backing layer are selected such that a linear pressure reduction rate of approximately 90% or higher is attained.

On the basis of the above-described results of study of Blades 6 to 9 and Blades 12 to 14 having the double-layer structure, a material having a 100% modulus value of approximately 7.5 MPa or higher is used in the edge layer, and a material having a relatively low permanent set value is used in the backing layer such that a linear pressure reduction rate of approximately 89.7% (or approximately 90%) or higher is attained. Thereby, the loss of resilience is prevented, and favorable spherical toner cleaning performance is maintained over time.

As described above, in the blade member 5 using rubber materials and formed by at least two or more layers, if a rubber material having a relatively high permanent set value is used in the edge layer 1 in contact with the photoconductor 10, a rubber material lower in permanent set value than the material of the edge layer 1 is used in the backing layer 2 so as to configure the blade member 5 to attain a linear pressure reduction rate of approximately 90% or higher. Thereby, favorable cleaning performance is maintained over time from the initial state, without a reduction in the contact pressure due to the loss of resilience.

Further, preferably the blade member 5 of the present embodiment minimizes variations in viscoelasticity of the edge layer 1 caused by environmental variations. Therefore, a rubber material having small variations in rebound resilience coefficient is used as the rubber material forming the edge layer 1.

Figure 8:
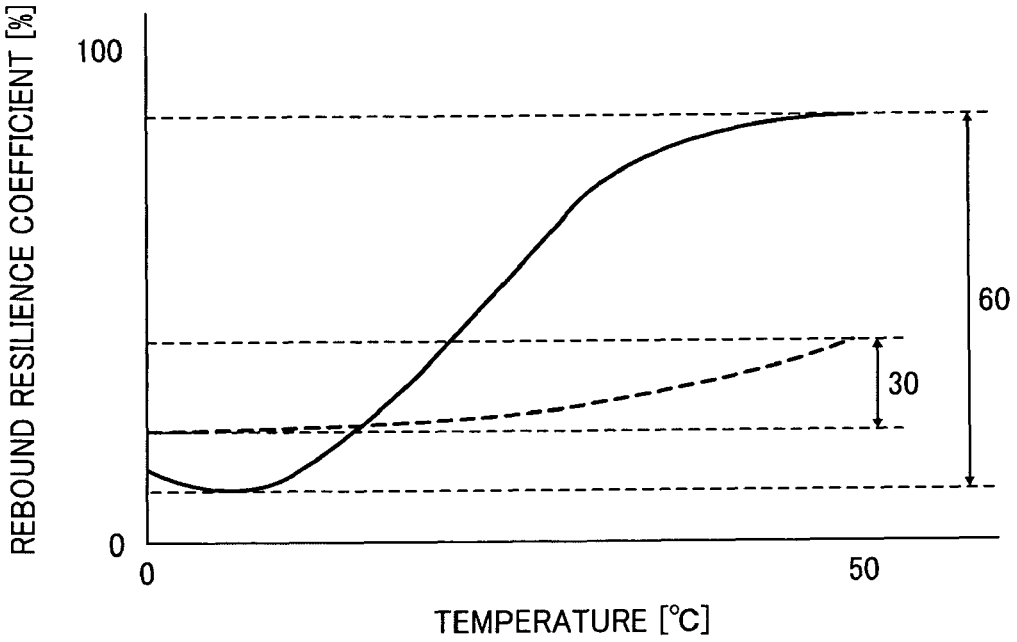
FIG. 8 is graphs of profiles of changes in rebound resilience coefficient caused by temperature changes.

FIG. 8 schematically illustrates profiles of changes in rebound resilience coefficient caused by temperature changes, with a solid line indicating the profile of changes of a rubber material that has been used in a background blade member, and a broken line indicating the profile of changes of a rubber material used in the edge layer 1 of the blade member 5 according to the present embodiment. In the profile of changes of the rubber material indicated by the solid line, the rebound resilience coefficient changes by approximately 60% between a temperature of 0 degree Celsius and a temperature of 50 degrees Celsius. By contrast, in the profile of changes of the rubber material used in the edge layer 1 of the present embodiment, which is indicated by the broken line, the change in the rebound resilience coefficient between a temperature of 0 degree Celsius and a temperature of 50 degrees Celsius is suppressed to approximately 30%.

The toner removal performance and the durability affected by blade abrasion are substantially affected by the rebound resilience coefficient of the rubber material used in an edge portion of the blade member. In the case of the rubber material that has been used in the background blade member, which is indicated by the solid line, the rebound resilience coefficient substantially varies with temperature. Therefore, toner removal performance is substantially changed or degraded with temperature. Further, characteristics of the blade member also tend to change with temperature, exhibiting substantial variation in durability or life depending on the temperature at which the blade member is used.

If the durability or life of the blade member varies with temperature at which, the following issue arises. That is, in a configuration allowing integral replacement of the blade member and the other components as a photoconductor unit, as in the process cartridge 121, if deterioration of the durability or a reduction in the life of the blade member is caused by the temperatures at which the blade member is used, there arises a need to replace the photoconductor unit even though the other components might not need replacement. Conversely, if improvement of the durability or an increase in the life of the blade member is caused by the temperatures at which the blade member is used, there arises a need to replace the photoconductor in accordance with the life of the other components even though the blade member is still usable.

By contrast, if a material having small variations in rebound resilience coefficient caused by temperature changes, as indicated by the broken line in FIG. 8, is used as the rubber material forming the edge layer 1, toner removal performance remains stable even in the face of environmental variations, with little variation in durability caused by the temperatures at which the blade member. Accordingly, the life of the blade member 5 can be easily adjusted to match the life of the other components forming the photoconductor unit.

In addition to this reduction of changes in rebound resilience coefficient of the edge layer 1 caused by temperature changes, as in the edge layer 1 a material having small variations in rebound resilience coefficient caused by temperature changes is also used in the backing layer 2, even though the material used in the backing layer 2 is set to be lower in 100% modulus value and permanent set value than the material used in the edge layer 1. Thereby, stable toner removal performance and stable durability are obtained against environmental variations. That is, the smaller the temperature dependence of the rebound resilience coefficient, the more stably the cleaning operation is performed independently of temperature. Accordingly, stable cleaning performance can be maintained over time.

Further, a material having a tan δ peak temperature lower than approximately 10 degrees Celsius is used as the rubber material forming the edge layer 1 or the backing layer 2. Thereby, the edge layer 1 or the backing layer 2 functions as a rubber material even at relatively low temperatures of approximately 10 degrees Celsius, and desired cleaning performance is obtained. Further, if the rubber material having a tan δ peak temperature lower than approximately 10 degrees Celsius is a material having a tan δ peak temperature lower than approximately 5 degrees Celsius, the edge layer 1 or the backing layer 2 functions as a rubber material at temperatures of approximately 5 degrees Celsius or higher. Further, if the rubber material having a tan δ peak temperature lower than approximately 10° C. is a material having a tan δ peak temperature lower than approximately −20 degrees Celsius, the edge layer 1 or the backing layer 2 functions as a rubber material in an environment having a temperature of approximately −20 degrees Celsius or higher. Thereby, desired cleaning performance is obtained. That is, the lower tan δ peak temperature of the rubber material used in the edge layer 1 or the backing layer 2 makes it possible to use the material at lower temperatures.

In the above-described embodiment, the cleaning device 30, which includes the laminated blade member 5 including the edge layer 1 having a relatively high permanent set value and the backing layer 2 having a relatively low permanent set value, removes a foreign material adhering to a surface of the photoconductor 10 as a cleaning target. The cleaning target cleaned by a cleaning device including a blade member similar to the blade member 5 of the present embodiment is not limited to the photoconductor. For example, a blade member similar to the blade member 5 may be used as a cleaning member of the intermediate transfer belt cleaning device 167 for cleaning the intermediate transfer belt 162 as the cleaning target. Further, the cleaning target is not limited to the toner image carrying member, such as the photoconductor 10 and the intermediate transfer belt 162. Thus, a blade member similar to the blade member 5 may be used as a cleaning member of a cleaning device for cleaning a recording medium conveying belt, which conveys a recording medium having an untransformed toner image formed thereon, as the cleaning target. Further, the image forming apparatus including the recording medium conveying belt is not limited to the electrophotographic image forming apparatus. Thus, a blade member similar to the blade member 5 may be used as a cleaning member of a cleaning device for cleaning the recording medium conveying belt included in an inkjet image forming apparatus. Further, the blade member 5, which comes into contact with the photoconductor 10 in accordance with a counter method in the present embodiment, may alternatively employ a trailing method as the contact method.

As described above, the cleaning device 30 of the present embodiment includes the laminated blade member 5 formed by multiple layers made of materials different in permanent set value and the blade holder 3 serving as a holding member holding one end of the blade member 5. The cleaning device 30 cleans a surface of the photoconductor 10, i.e., a moving surface of a cleaning target, by bringing the edge portion 1*e*, which corresponds to a leading end ridgeline portion on the other end of the blade member 5, into contact with the surface of the photoconductor 10. In the above-described cleaning device 30, the respective materials and thicknesses of the layers are selected such that the linear pressure reduction rate of the blade member 5 measured in contact with the photoconductor 10 by a predetermined method is approximately 90% or higher. Thereby, the initial cleaning performance is sufficiently maintained with the configuration using the laminated blade member 5 formed by the multiple layers.

Further, in the cleaning device 30, the edge layer 1 including the edge portion 1*e* and forming one of the multiple layers of the blade member 5 is made of a material higher in permanent set value than the material of the backing layer 2, which forms the other layer. In the laminate blade using, as the blade member 5, the elastic member thus formed by at least two or more layers, a material relatively high in hardness and 100% modulus value is used in the edge layer 1 that comes into contact with the photoconductor 10 serving as an image carrying member. Further, a material lower in hardness, 100% modulus value, and permanent set value than the material of the edge layer 1 is used in the backing layer 2 formed by at least one or more layers, and the blade 5 attains a linear pressure reduction rate of approximately 90% or higher. Thereby, variations in contact condition and contact pressure caused by the loss of resilience are prevented for a relatively long time from the initial state, and favorable cleaning performance for cleaning off small-diameter highly spherical toner particles is maintained for a relatively long time.

In the past, background blade members used to clean off ground toner or polymerized toner including toner particles having relatively low sphericity and a particle diameter of approximately 6 μm or more commonly use a single-layer rubber material having a 100% modulus value of approximately 5 MPa or lower and a permanent set value of approximately 1.5% or lower. By contrast, if a urethane rubber material relatively high in hardness and 100% modulus value is used, it is possible to increase the contact pressure in the contact area of the blade member in contact with an image carrying member such as a photoconductor, and to clean off polymerized toner including small-diameter spherical toner particles. In general, however, the urethane rubber material having a relatively high 100% modulus value tends to have a relatively high permanent set value. Therefore, if a material having a relatively high 100% modulus value is used in a blade member in which a single-layer urethane rubber material having a free length used in the past is supported by a metal support plate serving as a holding member, so-called loss of resilience tends to occur in the blade member. In some cases, therefore, the initial cleaning performance fails to be maintained, and it is difficult to maintain the cleaning performance for a relatively long time.

Meanwhile, in the cleaning device 30 of the present embodiment, in order to increase the contact pressure in the contact area of the blade member 5 in contact with a cleaning target and thereby clean off polymerized toner including small-diameter spherical toner particles, a material relatively high in hardness and 100% modulus value is used in the edge layer 1 forming a portion of the blade member 5 in contact with the cleaning target. Herein, it is desired to use, in the edge layer 1, a rubber material having a 100% modulus value of approximately 6 MPa or higher. To prevent the loss of resilience, which is an issue arising in the use of a material having a relatively high 100% modulus value, the rear side of the edge layer 1, i.e., the far side of the edge layer 1 from the cleaning target is provided with the backing layer 2 made of a rubber material different in composition from the rubber material of the edge layer 1. As the material used in the backing layer 2, a material lower in hardness, 100% modulus value, and permanent set value than the material of the edge layer 1 is used.

In addition to the above-described combination of the lower hardness, the lower 100% modulus value, and the lower permanent set value of the material of the backing layer 2 than in the material of the edge layer 1, the material of the backing layer 2 is selected as appropriate such that a linear pressure reduction rate of approximately 90% or higher is attained. Thereby, the deterioration of the cleaning performance due to the loss of resilience is suppressed. Further, even if a material relatively high in permanent set value and 100% modulus value is used in the edge layer 1, favorable cleaning performance for cleaning off polymerized toner including small-diameter spherical toner particles is maintained for a relatively long time from the initial state.

Further, in the cleaning device 30, a rubber material having a 100% modulus value in a range of approximately 6 MPa to approximately 12 MPa at a temperature of 23 degrees Celsius is used as the material forming the edge layer 1 of the blade member 5. In this case, the temperature of 23 degrees Celsius is a standard room temperature. Thereby, the contact pressure of the blade member 5 applied to the photoconductor 10 is increased, and polymerized toner including small-diameter spherical toner particles is cleaned off.

Further, the cleaning device 30 uses, as the material forming the edge layer 1 of the blade member 5, a rubber material in which the difference between the maximum value and the minimum value of the rebound resilience coefficient in a temperature change range of 0 degree Celsius to 50 degrees Celsius is approximately 30% or less. With this reduction in the temperature dependence of the rebound resilience of the edge layer 1, the change or deterioration of the toner removal performance due to the usage environment is prevented, and stable toner removal performance and stable durability are obtained.

Further, the cleaning device 30 uses, as the material forming the edge layer 1 of the blade member 5, a rubber material having a tan δ peak temperature lower than approximately 10 degrees Celsius. Thereby, even in a relatively low temperature environment having a temperature of approximately 10 degrees Celsius, the edge layer 1 functions as a rubber material, and desired cleaning performance is obtained.

Further, the cleaning device 30 uses, as the material forming the backing layer 2 of the blade member 5, a rubber material in which the difference between the maximum value and the minimum value of the rebound resilience coefficient in a temperature change range of 0 degree Celsius to 50 degrees Celsius is approximately 30% or less. Further, the cleaning device 30 uses a rubber material having a tan δ peak temperature lower than approximately 10 degrees Celsius, as the material for forming the backing layer 2. With this reduction in the temperature dependence of the edge layer 1 and the backing layer 2, more stable toner removal performance and more stable durability are obtained.

Further, it is desired to provide the cleaning device 30 with a lubricant application device that applies a lubricant to the surface of the photoconductor 10 as a cleaning target. The lubricant applied to the cleaning target helps to improve the cleaning performance of the blade member 5. Further, with the lubricant applied to the photoconductor 10, the surface of the photoconductor 10 is protected by the lubricant in the charging process performed by the charging device 40. Accordingly, deterioration of the surface of the photoconductor 10 by the charging is suppressed.

Further, the printer 100 of the present embodiment finally transfers an image formed on the photoconductor 10, which is a latent image carrying member having a moving surface, onto a transfer sheet serving as a recording medium. The printer 100 includes the process cartridge 121 that is removably installable in the body of the printer 100, and that integrally supports the photoconductor 10 and a cleaning device that removes an unnecessary foreign material adhering to the surface of the photoconductor 10 as the above-described cleaning target. With the use of the cleaning device 30 of the present embodiment as a cleaning device of the process cartridge 121, the process cartridge 121 is capable of maintaining the initial contact state longer than before and stably cleaning the photoconductor 10 for a relatively long time.

Further, the printer 100 transfers a toner image formed on the photoconductor 10, which is an image carrying member having a moving surface, onto the intermediate transfer belt 162 serving as an intermediate transfer member, and finally transfers the toner image onto a transfer sheet serving as a recording medium. The printer 100 includes the secondary transfer device 160 serving as an intermediate transfer unit that is removably installable in the body of the printer 100, and that integrally supports the intermediate transfer belt 162 and the intermediate transfer belt cleaning device 167 serving as a cleaning device that removes an unnecessary foreign material adhering to the surface of the intermediate transfer belt 162 as the cleaning target. If a cleaning device including a blade member similar to the blade member 5 of the cleaning device 30 is used as the intermediate transfer belt cleaning device 167, the secondary transfer device 160 is capable of favorably cleaning the intermediate transfer belt 162 for a relatively long time.

Further, the printer 100 is an image forming apparatus that finally transfers a toner image formed on the photoconductor 10, which is a surface moving member, onto a transfer sheet. With the use of the cleaning device 30 as a cleaning device for removing an unnecessary foreign material adhering to the surface of the photoconductor 10, the photoconductor 10 is favorably cleaned for a relatively long time, and the printer 100 is capable of performing a favorable image forming operation.

The toner forming the toner image in the printer 100 is a polymerized toner including toner particles having a shape factor SF1 in a range of approximately 100 to approximately 150. Some of polymerized toners include substantially spherical toner particles, and are capable of forming a high-quality toner image. To remove such spherical toner particles, however, a high level of removal performance is necessary. The cleaning device 30 attains both relatively high contact pressure and maintenance of the initial contact state, and thus is capable of favorably cleaning the spherical toner particles requiring a high level of removal performance. Accordingly, the printer 100 is capable of stably forming a high-quality image.

Further, some of image forming apparatuses include a recording medium conveying unit that is removably installable in the body of the image forming apparatus that forms an image on a recording medium carried on a surface of a recording medium conveying belt serving as a recording medium conveying member being a surface moving member, and that integrally supports the recording medium conveying belt and a conveying belt cleaning device for removing an unnecessary foreign material adhering to the surface of the recording medium conveying belt as the cleaning target. If a cleaning device including a blade member similar to the blade member 5 of the cleaning device 30 is used as the conveying belt cleaning device of the thus configured image forming apparatus, the recording medium conveying unit is capable of favorably cleaning the recording medium conveying belt for a relatively long time.

The above-described embodiments are illustrative and do not limit the present invention. Thus, numerous additional modifications and variations are possible in light of the above teachings. For example, elements or features of different illustrative and exemplary embodiments herein may be combined with or substituted for each other within the scope of this disclosure and the appended claims. Further, features of components of the embodiments, such as number, position, and shape, are not limited to those of the disclosed embodiments and thus may be set as preferred. It is therefore to be understood that, within the scope of the appended claims, the disclosure of the present invention may be practiced otherwise than as specifically described herein.

The invention claimed is:

1. A cleaning device for cleaning a moving surface of a cleaning target, comprising:

a laminated blade member including multiple layers including a proximal edge layer, each of the multiple layers made of materials different in permanent set value; and a holding member to hold a distal end of the blade member, a proximal edge portion of the edge layer of the blade member at a free, leading end opposite the distal end of the blade member held by the holding member brought into contact with the surface of the cleaning target to clean the surface undergoes a linear pressure reduction rate of approximately 90% or higher.

2. The cleaning device according to claim 1, wherein the edge layer including the proximal edge portion is made of a material higher in permanent set value than any other one of the materials of the layers.

3. The cleaning device according to claim 1, wherein the edge layer including the proximal edge portion is made of a material having a 100% modulus value in a range of from approximately 6 MPa to approximately 12 MPa at a temperature of 23 degrees Celsius.

4. The cleaning device according to claim 1, wherein the edge layer including the proximal edge portion is made of a material in which the difference between maximum and minimum rebound resilience coefficient values across a temperature change range of from 0 degree Celsius to 50 degrees Celsius is approximately 30% or less.

5. The cleaning device according to claim 4, wherein the material forming the edge layer has a tan δ peak temperature lower than approximately 10 degrees Celsius.

6. The cleaning device according to claim 1, wherein the multiple layers of the blade member further includes a distal backing layer disposed against a distal surface of the edge layer and made of a material in which the difference between maximum and minimum rebound resilience coefficient values across a temperature change range of from 0 degree Celsius to 50 degree Celsius is approximately 30% or less.

7. The cleaning device according to claim 1, wherein the multiple layers of the blade member further includes a backing layer disposed against a distal surface of the edge layer and made of a material having a tan δ peak temperature lower than approximately 10 degrees Celsius.

8. A process cartridge removably installable in an image forming apparatus that transfers, onto a recording medium, an image formed on a moving surface of a latent image carrying member, wherein the process cartridge supports both the latent image carrying member and the cleaning device according to claim 1 as a single integrated unit.

9. An intermediate transfer unit removably installable in an image forming apparatus that transfers an image formed on a moving surface of an image carrying member onto a moving surface of an intermediate transfer member and then onto a recording medium, wherein the intermediate transfer unit supports both the intermediate transfer member and the cleaning device according to claim 1 as a single integrated unit.

10. An image forming apparatus comprising the cleaning device according to claim 1.

11. The image forming apparatus according to claim 10, wherein toner particles forming the image have a shape factor SF1 in a range of approximately 100 to approximately 150.

* * * * *